US006959877B2

(12) United States Patent
Diamond

(10) Patent No.: US 6,959,877 B2
(45) Date of Patent: Nov. 1, 2005

(54) CROSS-TIE FOR RAILROAD RAIL ASSEMBLY AND METHOD OF MANUFACTURING THE SAME

(75) Inventor: Martin Diamond, Erieville, NY (US)

(73) Assignee: ARE Technologies of Central New York, Inc., Cazenovia, NY (US)

( * ) Notice: Subject to any disclaimer, the term of this patent is extended or adjusted under 35 U.S.C. 154(b) by 0 days.

(21) Appl. No.: 10/692,520

(22) Filed: Oct. 24, 2003

(65) Prior Publication Data

US 2004/0089729 A1 May 13, 2004

Related U.S. Application Data

(63) Continuation-in-part of application No. PCT/US02/12919, filed on Apr. 24, 2002.

(60) Provisional application No. 60/288,177, filed on May 2, 2001.

(51) Int. Cl.[7] ..... E01B 3/00
(52) U.S. Cl. ..... 238/37; 238/36

(58) Field of Search ..... 238/36, 29, 30, 238/31, 37; 428/56, 105, 903.3; 156/95, 156/96

(56) References Cited

U.S. PATENT DOCUMENTS

| | | | | |
|---|---|---|---|---|
| 598,127 | A * | 2/1898 | Williams | 238/37 |
| 4,286,753 | A | 9/1981 | Lee | |
| 5,746,545 | A | 5/1998 | Parker, Jr. | |
| 5,996,901 | A | 12/1999 | Young | |
| 6,048,129 | A | 4/2000 | Rue | |
| 6,306,484 | B1 | 10/2001 | Bove et al. | |
| 6,316,069 | B1 | 11/2001 | Bove et al. | |
| 6,368,690 | B1 | 4/2002 | Bove | |
| 6,372,069 | B1 | 4/2002 | Walls | |

* cited by examiner

*Primary Examiner*—Mark T. Le
(74) *Attorney, Agent, or Firm*—Burr & Brown

(57) ABSTRACT

A cross-tie for a railroad rail assembly and a method of manufacturing the same, wherein the cross-tie includes a plurality of recycled tire treads stacked along one of the width and height dimensions of the cross-tie, and secured to one another via an interposed adhesive material.

6 Claims, 3 Drawing Sheets

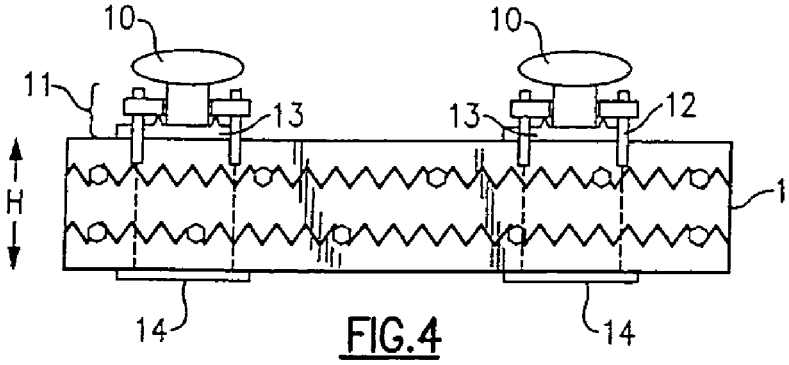
FIG.4
FIG.5
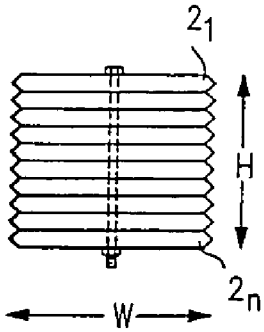
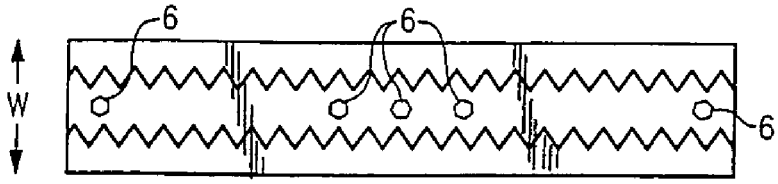
FIG.6
FIG.7
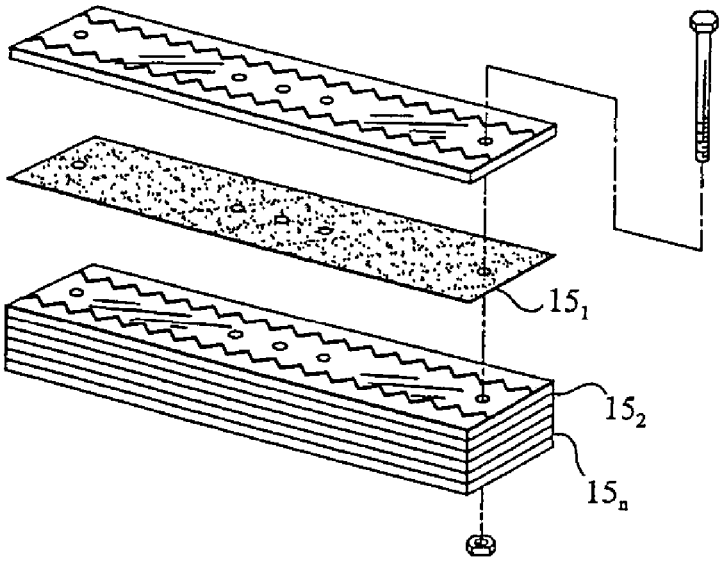

CROSS-TIE FOR RAILROAD RAIL ASSEMBLY AND METHOD OF MANUFACTURING THE SAME

CROSS REFERENCE TO RELATED APPLICATIONS

This application is a continuation-in-part of International Application No. PCT/US02/12919 having an international filing date of Apr. 24, 2002, which designated the United States, which in turn is the Non-Provisional of U.S. Provisional Patent Application Ser. No. 60/288,177, filed May 2, 2001, the entireties of which are incorporated herein by reference.

FIELD OF THE INVENTION

The present invention relates to a cross-tie for a railroad rail assembly and its method of manufacture, and, in particular, a cross-tie made from recycled tire treads.

BACKGROUND OF THE INVENTION

Railroad rail assemblies use cross-ties to support the steel rails that carry freight and passenger trains. Historically the cross-ties have been made from wood, and have been treated with creosote. More recently, creosote has been classified as a carcinogen, and most localities have placed severe restrictions on its use, if not banned its use altogether. As a result, creosote-soaked cross-ties have been replaced with pressure treated timbers. Pressure treated timbers, however, have a substantially reduced life expectancy when compared to creosote timbers.

Another problem with wooden cross-ties is their inability to hold the rails they support within "Standard Gauge" for extended periods of time. Cross-ties must have some degree of flexibility in order to deflect under the load of a passing train, and to this extent wooden cross-ties exhibit sufficient support and durability. However, the inherent problem with any wooden tie is its limited useable life due to its tendency to decay when exposed to the elements. Consequently, degeneration of the wooden ties eventually loosens the railroad spikes, allowing the rails to move apart, which could eventually result in derailment. Therefore, the use of wooden cross-ties requires frequent maintenance and replacement. Also, the decay and breakdown of creosote soaked ties is a threat to the environment, in that State Statutes and Local Ordinances have drastically increased the cost associated with disposing of these types of cross-ties.

There have also been attempts to use reinforced concrete cross-ties and steel cross-ties to address some of the problems associated with wooden cross-ties. Concrete cross-ties, however, are expensive compared to wooden cross-ties and are not as flexible as wooden cross-ties. Concrete cross-ties have a tendency to fail under adverse conditions, at which time the cross-tie will need replacement. Accordingly, while concrete cross-ties can be used for "Light Rail" passenger track, they are not as suitable for freight tracks due to the extreme weights inherent in freight trains.

Steel cross-ties have also been used. While steel can handle the heavy weight of freight traffic and will last for long periods of time, steel cross-ties are also expensive compared to wooden cross-ties. In order to insure the integrity of steel cross-ties, frequent inspection and welding is required thus substantially increasing their maintenance costs.

Another known cross-tie is that of U.S. Pat. No. 5,996,901 to Young. The '901 cross-tie includes a stack of elastomeric layers (e.g., recycled tire treads) as a filler layer interposed between and fastened to a pair of rigid plates. The stack and plate assembly is held together by a plurality of wedge-shaped members and fasteners which are fixed to form non-perpendicular angles with the stack. The wedge-shaped members and bolts are positioned at multiple locations along the longitudinal (i.e., length) direction of the cross-tie.

Like the above-mentioned steel cross-ties, the '901 cross-tie assembly is expensive. The expense is attributed not only to the inclusion of the rigid plates (e.g., steel), but also to the high number of wedge-shaped members and bolts required by the design. Ultimately, the design of the '901 cross-time assembly is cost prohibitive.

It would be desirable to provide an environmentally friendly solution to the above-discussed problems with the prior art cross-ties. While several have attempted to provide such a solution, the expense involved has prevented any such solution from coming to fruition.

SUMMARY OF THE INVENTION

It is an object of the present invention to provide an environmentally friendly cross-tie that overcomes all the problems with the above-discussed prior art.

The present invention provides a cross-tie made of recycled tire treads that are stacked and secured to one another in the configuration of a traditional-sized cross-tie. The cross-tie of the present invention exhibits a rigidity comparable to that of wooden cross-ties, can handle the load of passenger and freight traffic, and does not present any substantial harm to the environment. Moreover, since recycled tire treads often can be obtained at a negative cost (recyclers often pay for disposal of tire treads), cross-ties according to the present invention can be manufactured at an expense that is comparable to that of wooden cross-ties.

According to one embodiment of the present invention, a cross-tie for a railroad rail assembly is provided that has a first dimension extending in a first direction, a length extending in a direction substantially perpendicular to the first direction, and a second dimension extending in a second direction substantially perpendicular to the first and length directions. The cross-tie includes a plurality (n) of recycled tire treads stacked and secured to one another in one of the first and second directions, and each layer has a length substantially coextensive with the length of the cross-tie, a width substantially coextensive with one of the height and width of the cross-tie, and a thickness equal to 1/n of the other one of the height and width of the cross-tie.

In accordance with a preferred embodiment of the present invention, a cemented elastomeric membrane layer is interposed between adjacent planar layers of the cross-tie to bond the layers to one another and form an integrally bonded body. When using recycled tire treads, the cemented membrane layer includes standard cement and membrane products, which are used in the same manner as typically used to retread or recap used tires. Examples of the membrane include CHEM GUM and PC CUSHION GUM (both manufactured by Patch Rubber Company), and examples of the cement include FIBERBOND brush type cement and HV CHEMICAL CEMENT (both manufactured by Patch Rubber Company).

According to another embodiment of the present invention, a cross-tie for a railroad rail assembly is provided, including a plurality of tire treads that are stacked and secured to one another via an interposed membrane and an adhesive to form a stacked structure. The stacked structure has a height defining a height direction, a width defining a width direction and a length defining a length direction, and the tire treads are stacked in the height direction. First and second support members are also provided, respectively disposed on a first side and an opposed second side of the stacked structure such that the stacked structure is interposed between the first and second support members in the width direction. The first and second support members each have a height substantially coinciding with the height of the stacked structure, a width, and a length substantially coinciding with the length of the stacked structure. The first and second support members are respectively secured to the first and second sides of the stacked structure via at least one of an interposed cement, an adhesive and a membrane. A third support member is also provided, disposed on an upper surface of each the first and second support members and on an upper surface of the stacked structure. The third support member has a height, a length that substantially coincides with the length of the stacked structure and the length of each the first and second support members, and a width that is greater than the width of the stacked structure so that the third support member overlaps the upper surface of the first and second support members in the width direction such that the third support member substantially covers the upper surfaces of the first and second support members and the upper surface of the stacked structure. The width of the cross-tie is defined by the width of the third support member, the height of the cross-tie is defined by a combined height of the stacked structure and the third support member, and the length of the cross-tie is defined by any one of the length of the stacked structure, the first support member, the second support member, and the third support member. The lower surface of the cross-tie is defined by at least one of the tire treads of the stacked structure.

The cross-tie according to this embodiment of the present invention provides additional structural support and increased durability in the form of the first and second support members. Additionally, the particular configuration of the third support member, with respect to the first and second support members, provides protection from environmental contamination and degradation by covering the otherwise exposed upper surface of the joining interface between the stacked structure and the first and second support members to prevent water, oil and other unwanted contaminants and debris from invading the interface between the support members and the stacked structure.

According to another embodiment of the present invention, a railroad rail assembly is provided that includes a pair of substantially parallel rails extending in a first direction, and a plurality of cross-ties supporting the rails and extending in a direction substantially perpendicular to the first direction. Each of the cross-ties includes a plurality of recycled tire treads stacked and secured to one another either along the first direction or in a direction normal to the first direction.

According to a preferred method of manufacturing the cross-tie of the present invention, a plurality of recycled tire treads, each having a length substantially coextensive with the length of the cross-tie and a width substantially coextensive with one of the height and width of the cross-tie are stacked one upon another in the other one of the height and width directions of the cross-tie, and the stacked layers are secured to one another.

Again, a cemented membrane layer is interposed between adjacent tire treads, and it is preferred to use membrane and cement products typically used to retread or recap used tires.

The cross-tie of the present invention overcomes all the problems with the prior art cross-ties described above, because it is considerably more environmentally friendly than creosote-soaked cross-ties, exhibits rigidity comparable to that of wooden cross-ties, and can be manufactured at a price that makes it comparably priced to wooden cross-ties.

Another advantage of the present cross-tie is that, since its major component is rubber, it inherently acts as a vibration damper for the rails that it supports. This vibration damping characteristic reduces rail noise and preserves the integrity of the underlying rail bed, as less vibration from passing rail cars is transmitted to the rail bed.

BRIEF DESCRIPTION OF THE DRAWINGS

For a better understanding of the nature and objects of the invention, reference should be made to the following detailed description of a preferred mode of practicing the invention, read in connection with the accompanying drawings, in which:

FIG. 4 shows the cross-tie of FIGS. 1–3 supporting a railroad rail assembly (shown in partial cross-section);

FIG. 5 is a side view of a cross-tie according to another embodiment of the present invention;

FIG. 6 is a top view of the cross-tie shown in FIG. 5;

FIG. 7 is an exploded view of the cross-tie shown in FIG. 5; and

DETAILED DESCRIPTION OF THE INVENTION

Figure 1:
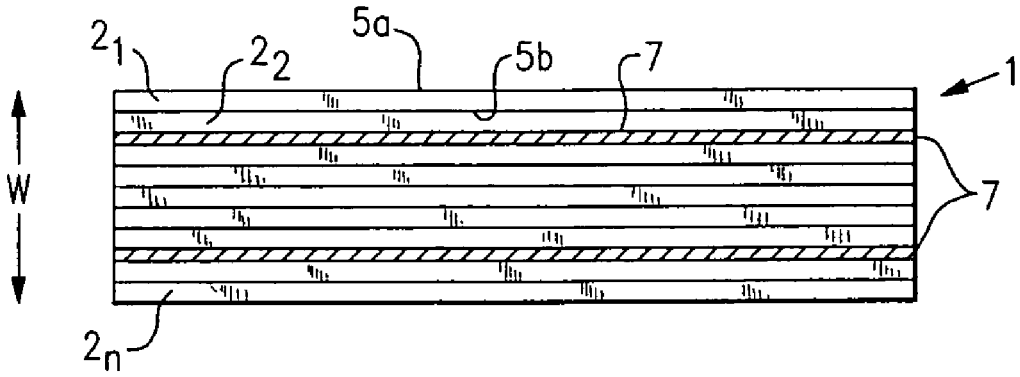
FIG. 1 is a top view of a cross-tie according to one embodiment of the present invention.
Figure 2:
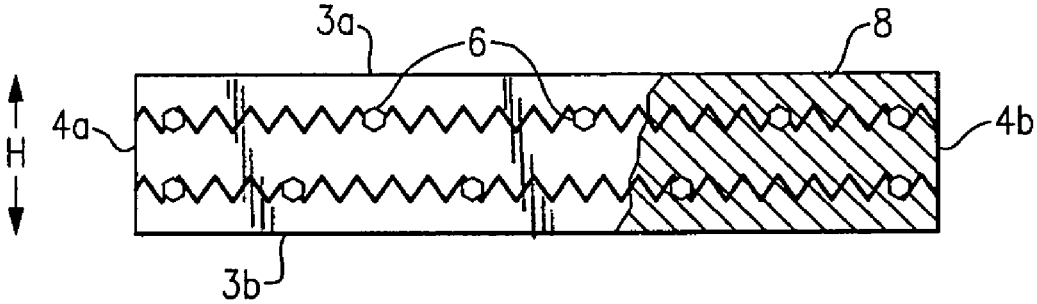
FIG. 2 is a side view of the cross-tie shown in FIG. 1, with the addition of a partial outer skin layer.
Figure 3:
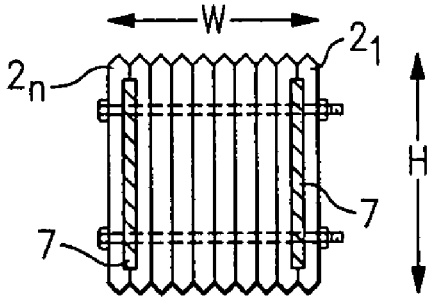
FIG. 3 is an end cross-sectional view of the cross-tie shown in FIG. 1.

The following description is provided with reference to FIGS. 1–4, wherein the tire treads are shown stacked along the width direction of the cross-tie. The invention also encompasses cross-ties wherein the tire treads are stacked along the height direction of the cross-tie, as shown in FIGS. 5 and 6. In the latter case, the "W" and "H" dimensions shown in FIGS. 1–4 would be reversed. That is, FIG. 1 would be a side view and FIG. 2 would be a top view. FIG. 3 would still be a cross-sectional end view, although rotated 90° about the longitudinal center of the cross-tie.

FIG. 1 shows a top view of a cross-tie in accordance with one embodiment of the present invention. The cross-tie 1 has a width W extending in a first direction (which is parallel to the extension of the rails to be supported by the cross-tie), a length extending in a direction substantially perpendicular to the width direction, and a height H extending in a second direction (in and out of the paper in FIG. 1) substantially perpendicular to the first and length directions.

The cross-tie includes a plurality of layers $\mathbf{2}_1, \mathbf{2}_2, \ldots \mathbf{2}_n$, each of which is a tire tread from a recycled tire. The tire treads are formed by cutting the sidewalls off of a tire at the junction between the tread and the sidewalls. The resultant tire tread includes the steel belt reinforcement layers from the original tire.

Each layer 2 includes a top side 3*a* and a bottom side 3*b*, as shown more clearly in FIG. 2. Each layer also includes a first end 4*a* and a second end 4*b*, as well as a front surface 5*a* and a back surface 5*b*.

The plurality of layers 2 are stacked (front surface of $\mathbf{2}_2$ to back surface of $\mathbf{2}_1$, etc.) along the width direction, which, again, extends in the same direction as the rails to be supported by the cross-tie. Since the layers 2 are stacked on their sides 3*b*, the width of each layer defines the height H of the cross-tie, which can be seen more clearly in FIG. 3. When the tire treads are arranged and secured in this fashion, they collectively exhibit more than sufficient strength to support a rail assembly. Moreover, the stacked layers also exhibit a rigidity comparable to that of wooden cross-ties.

It is preferred that the adjacent layers are adhered together through interposed cemented membranes. When using tire treads to form the layers, typical elastomeric membranes used to retread or recap used tires are preferred. For example, membranes and cements sold by Patch Rubber Company under the tradenames of CHEM GUM and PC CUSHION GUM, and FIBERBOND and HV CHEMICAL CEMENT, respectively, are well suited for this application. In addition, the cementing operation can be performed under heated or room temperature conditions, depending upon the type of membrane and cement that is used.

Although there is no limitation on the thickness of the membrane, both 40 mm and 60 mm membranes provide sufficient adhesion between adjacent tires, so that the resultant stack of tires exhibits more than sufficient mechanical strength to function as a cross-tie.

It is also possible to incorporate one or more steel plates 7 between some of the adjacent layers 2. Although the steel plates 7 provide added strength in the height direction of the cross-tie, including steel plates in this capacity is ultimately cost prohibitive. In any event, the inventors discovered that, due to the surprising strength of the tire treads and interposed membranes alone, steel plates are not necessary in most cases, especially when the tire treads are stacked so as to lay flat and secured using an adhesive (see FIG. 7).

FIGS. 2 and 3 show that a plurality of fasteners 6 (e.g., galvanized nut-bolt-washer assemblies) extend through the stacked layers 2 along the direction of width of the cross-tie. If the layers are adhered together as explained earlier, the fasteners may not be necessary. The fasteners may still play a role, however, in holding the layers together while the cemented membrane layers set or cure. While there is no specific pattern required for the fasteners, they must be positioned so as not to interfere with the mechanism that will hold the rail to the cross-ties, as explained in more detail later herein.

It is also possible to secure the layers 2 to one another through a vulcanization process, either alone or in combination with the fasteners 6. If whole tires are used to implement manufacture of the cross-tie of the present invention, the sidewall rubber will be available as a scrap material that could be pulverized and interposed among the various layers 2. The layers, with the pulverized interposed rubber particles and other vulcanizing agents, could then be secured to one another through a conventional vulcanization process.

It is also possible to form a skin layer 8 covering at least a portion of an outer surface of the cross-tie, as shown in partial view in FIG. 2. Again, this skin layer could be formed from the rubber scrap from the sidewalls of the original tires. Such a skin layer could also include other additives, such as UV inhibitors, and the like.

As explained above, since layers 2 are formed from tire treads taken from recycled tires, the layers essentially comprise an elastomeric matrix and a reinforcing member (e.g., a steel belt) positioned within the matrix. It is within the scope of the present invention, however, to use other layer materials.

FIG. 4 shows the cross-tie of FIGS. 1–3 supporting rails 10 of a railroad rail assembly. The railroad rail assembly includes a rail connection mechanism 11 for securing the rails 10 to the cross-ties 1. The rail connection mechanism 11 includes threaded members 12 extending through the cross-tie in the height direction thereof. The rails 10 are seated in top plates 13, which are positioned between the rails 10 and the top of the cross-tie 1. The threaded members (e.g., a bolt) are secured to a bottom plate 14 positioned beneath the cross-tie 1. In a preferred embodiment, the bottom plate 14 includes threaded holes for receiving the threaded members 12. It is also preferred that the bottom plate 14 be secured to the bottom of each cross-tie 1 through suitable fasteners (e.g., screws), so that the bottom plate can be transported as part of the cross-tie itself.

The cross-tie of the present invention can be used in the construction of new railroad rail assemblies, or to replace deteriorated wooden cross-ties. In the latter case, the cross-tie of the present invention can be simply inserted beneath the railroad rail assembly to replace the deteriorating wooden cross-tie. In such a case, it is not necessary to elevate the railroad rail assembly, since the threaded members 12 of the rail connection mechanism 11 can be threaded from the top of the cross-tie into the threaded holes in the bottom plate 14 after the cross-tie is in position.

FIG. 5 is a side view of a cross-tie in accordance with another embodiment of the present invention, wherein the tire treads are stacked one upon another in the height direction of the cross-tie. In this case, the width of each tire tread or layer 2 is coextensive with the width W of the resultant cross-tie. The orientation shown in FIG. 5 is preferred, in some respects, compared to the orientation shown in FIGS. 1–4, since the rail connection mechanism 11 can employ standard railroad spikes extending into the various layers 2 of the cross-tie. Since there is no chance that the rail connection mechanism 11 would penetrate an interface between two adjacent layers 2, as in the case of the orientation shown in FIG. 4, the durability of the rail connection mechanism 11 and its attachment to the cross-tie is improved.

FIG. 6 is a top view of the cross-tie shown in FIG. 5, including fasteners 6 passing through all the layers 2 of the cross-tie. As shown in FIG. 6, the fasteners are spaced apart along the tie, such that one fastener exists on each end and three fasteners exist near the central region of the tie. This allows for sufficient fastening of the layers together, especially when combined with interposed cemented membranes, as discussed above. This arrangement of fasteners 6 also leaves more than sufficient room on the cross-tie for the rail connection spikes to be secured in the cross-tie without interference from the fasteners 6. Any arrangement of fasteners could be used.

FIG. 7 shows a partial exploded view of the cross-tie shown in FIG. 5, wherein membranes $\mathbf{15}_1$, $\mathbf{15}_2$ . . . $\mathbf{15}_n$ are interposed between adjacent tire treads. Although it is not shown in FIG. 7, as explained above, a suitable cement is preferably applied between the opposed surfaces of each membrane 15 and the surfaces of each tire tread that the membrane 15 contacts.

Figure 8:
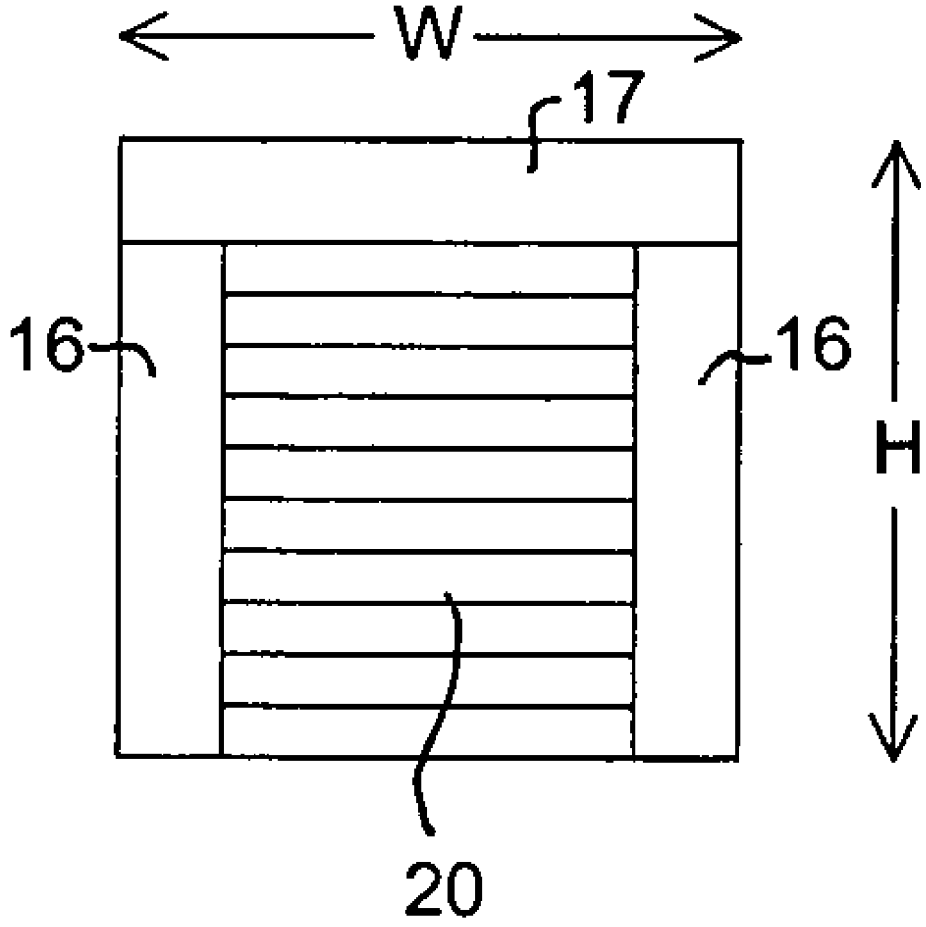
FIG. 8 is a cross-sectional view of a cross-tie according to another embodiment of the present invention.

FIG. 8 is a cross-sectional end view of a cross-tie according to another embodiment of the present invention. Like the embodiment shown in FIG. 5, the tire treads are stacked one upon another in the height direction of the cross-tie to form a stacked structure 20. In this case, the width of each tire tread layer is substantially coextensive with the width of the stacked structure 20. In addition, however, the cross-tie according to the embodiment shown in FIG. 8 includes support members 16 to provide additional structural stability and support member 17 to provide aesthetic value and increased durability and resistance to environment damage.

As shown, the lateral support members 16 are provided on opposed sides of the stacked layer structure 20 (including tire treads 2 and membranes 15 (see, e.g., FIGS. 5 and 7)). The lateral support members 16 have a width that is greater than the height of an individual tire tread layer 2, and the lateral support members 16 have a height that substantially coincides with the total height of the stacked structure 20. The length of the lateral support members 16 also substantially coincides with the length of the stacked structure 20.

Preferably, the lateral support members 16 are also made from an elastomeric material, such as a tire tread. The lateral support members 16 can be secured to the sides of the stacked structure 20 by cementing, using an adhesive or a membrane in connection with an appropriate cement in a similar manner to that described above with respect to cementing the layers 2 and membrane 15, shown in FIG. 7.

While the lateral support members 16 provide additional support for the stacked structure 20 shown in FIG. 8 in the second (height) direction and along the length direction, an upper support member 17 provides a degree of added structural support in the first (width) direction and along the length direction, as well as environmental protection. That is, in conjunction with the lateral support members 16, the upper support member 17 provides further structural stability and insulates the upper surface of the support members 16 and the stacked structure 20 that is sandwiched between the lateral support members 16 from exposure to the environment.

As shown in FIG. 8, the upper support member 17 has a width that overlaps the upper surfaces of the layered support members 16 and the upper surface of the stacked structure 20, such that the width of the upper support member 17 spans the distance between the outermost lateral edges of each of the lateral support members 16. In that manner, the width of the upper support member 17 substantially defines the total width of the cross-tie. The length of the upper support member 17 substantially coincides with the length of the lateral support members 16 and the stacked structure 20. In that manner, the length of the upper support member 17 also substantially defines the length of the cross-tie.

Since the orientation of the upper support member is substantially perpendicular to the orientation of the lateral support members 16, the upper support member 17 effectively covers the top surfaces of the stacked structure 20 and the lateral support members 16, including the portion of the upper surfaces at the junction between the stacked structure 20 and the lateral support members 16, such that the surface interface between the stacked structure 20 and the lateral support members 16 (in the width and length directions) is essentially closed off by the position of the upper support member 17 across the width and along the length directions. In that manner, the cover-like upper support member 17 effectively prevents environmental contaminants, such as water, oil, or debris, for example, from penetrating the lateral interface between the stacked structure 20 and the lateral support members 16 (in the height direction) and prevents the support members from delaminating or peeling away from the lateral sides of the layered structure 20 of the cross-tie. Thus, in addition to providing improved durability by lending structural support, the configuration of the support members 16, 17 provided added environmental resistance and durability.

The cross-tie shown in the drawings is very simple and cost effective to manufacture. Again, the layers are most suitably made from recycled tire treads, which effectively provides a negative raw material cost.

According to a preferred method of manufacture, used tires are cut to remove the side walls, and then the treads are inspected (e.g., visually and electronically) for defects. Accepted tread circles are buffed to remove tread rubber and to achieve the desired thickness, to shape the tread, and to prepare the surface for bonding. The inner surface is further prepared by buffing to remove silicone and a portion of the inner curve so the tread is as flat as possible. The tire treads are cut to a length equal to the length L of the desired cross-tie. If necessary, the width of each tire tread is also cut to match one of the height H and width W of the desired cross-tie. The other one of the height H and width W of the cross-tie is established by dividing the desired height or width of the cross-tie by the thickness of the tire treads, and then employing the appropriate number of tire treads to achieve the desired cross-tie height H or width W. For example, if each tire tread is one inch thick and the desired height or width of the cross-tie is ten inches, then ten tire treads would be used.

Once the tire treads are cut to the appropriate size, they are stacked with the sides 3*a*, 3*b* and ends 4*a*, 4*b* of each tread in substantial alignment, basically as shown in FIG. 1. The tire treads could be stacked on their sides or stacked flat one upon the other. This latter stacking direction will likely facilitate handling of the individual tire treads as it allows gravity to assist in maintaining the tire treads in position. The appropriate cement and membrane materials are interposed between adjacent layers as they are stacked (it may be desirable to roughen the surface of the tire treads to enhance adhesion of the cement). The layers are then pressed together (e.g., by using a press) and fasteners 6 are added at appropriate intervals. Once the cement has set or cured, excess adhesive is removed by grinding the sides of the stack. This grinding also evens the stacking, improves appearance, and brings the stack to its final size. The resultant cross-tie is then ready for use or stock storage.

If desired, steel reinforcing plates can also be positioned between one or more adjacent pairs of the tire treads, and then all the treads would be secured to one another using an appropriate fastening mechanism, such as that exemplified above.

While the present invention has been particularly shown and described with reference to the preferred mode as illustrated in the drawings, it will be understood by one skilled in the art that various changes in detail may be effected therein without departing from the spirit and scope of the invention as defined by the claims.

What is claimed is:

1. A cross-tie for a railroad rail assembly, said cross-tie comprising:

a plurality of tire treads, said tire treads being stacked and secured to one another via an interposed membrane and an adhesive to form a stacked structure, said stacked structure having a height defining a height direction, a width defining a width direction and a length defining a length direction, wherein said tire treads are stacked in said height direction and wherein each of said tire treads has substantially straight and continuous side surfaces along its length, at least one of the upper and lower surfaces of said cross-tie is defined by at least one tire tread, and the thickness of said elastomeric membrane is less than the thickness of said tire tread;

first and second support members respectively disposed on a first side and an opposed second side of said stacked structure such that said stacked structure is interposed between said first and second support members in said width direction, said first and second support members each having a height substantially coinciding with said height of said stacked structure, a width, and a length substantially coinciding with said length of said stacked structure, wherein said first and second support members are respectively secured to said first and second sides of said stacked structure via at least one of an interposed cement, an adhesive and a membrane; and a third support member disposed on an upper surface of each said first and second support members and on an upper surface of said stacked structure, said third support member having a height, a length that substantially coincides with said lengths of said stacked structure and each said first and second support members, and a width that is greater than said width of said stacked structure so that said third support member overlaps said upper surfaces of said stacked structure and said first and second support members in said width direction such that said third support member substantially covers said upper surfaces of said first and second support members and said upper surface of said stacked structure, wherein said third support member is respectively secured to said upper surfaces of said stacked structure and said first and second support members via at least one of an interposed cement, an adhesive and a membrane;

whereby a width of said cross-tie is defined by said width of said third support member, a height of said cross-tie is defined by a combined height of said stacked structure and said third support member, and a length of said cross-tie is defined by any one of said length of said stacked structure, said first support member, said second support member, and said third support member; and wherein a lower surface of said cross-tie is defined by one of said tire treads of said stacked structure.

2. The cross-tie of claim 1, wherein at least one of said first, second and third support members is a tire tread.

3. The cross-tie of claim 1, wherein at least two of said first, second and third support members is a tire tread.

4. The cross-tie of claim 1, wherein each of said first, second and third support members is a tire tread.

5. The cross-tie of claim 1, further comprising an outer skin layer covering at least a portion of an outer surface of said cross-tie.

6. The cross-tie of claim 5, wherein said outer skin layer comprises rubber.

* * * * *